US005588475A

United States Patent [19]

Martin

[11] Patent Number: 5,588,475

[45] Date of Patent: Dec. 31, 1996

[54] WATER DIVERSION CHANNEL FOR THE JOINT BETWEEN DOOR SECTIONS OF A SECTIONAL DOOR

[75] Inventor: David O. Martin, Salt Lake City, Utah

[73] Assignee: Martin Door Manufacturing, Inc., Salt Lake City, Utah

[21] Appl. No.: 417,387

[22] Filed: Apr. 5, 1995

[51] Int. Cl.[6] ..... E06B 7/14

[52] U.S. Cl. ..... 160/44; 160/235; 160/236

[58] Field of Search ..... 160/133, 201, 160/236, 44, 235, 229.1, 232, 218

[56] References Cited

U.S. PATENT DOCUMENTS 5,060,711 10/1991 Fimbell, III ..... 160/236 X

*Primary Examiner*—Blair Johnson

*Attorney, Agent, or Firm*—J. Winslow Young

[57] ABSTRACT

A water diversion channel for the joint between door sections of a sectional door. The water diversion channel is formed in the leading face of the tongue portion of the tongue and groove of the joint. The leading face of the tongue is formed with a slight undercut so as to provide the water diversion channel with a triangular cross section.

7 Claims, 2 Drawing Sheets

WATER DIVERSION CHANNEL FOR THE JOINT BETWEEN DOOR SECTIONS OF A SECTIONAL DOOR

BACKGROUND

1. Field of the Invention

This invention relates to sectional doors and, more particularly, to a novel tongue for the joint between door sections for minimizing water dripping from the joints as the sectional door is raised to its overhead, open position.

2. The Prior Art

Sectional doors are the closure of choice for large openings such as those found in garages, warehouses, storage sheds and the like. The sectional door is the preferred closure system for these types of openings since they are too wide for a conventional, hinge-mounted door. Specifically, a hinge-mounted door of these dimensions would require extremely robust hinges while the door itself would demand sufficient space in which to pivotally swing between the open and closed positions. As such, the sectional door has numerous advantages in that it provides a vertical closure that is strong, decorative, and yet stores out of the way in its elevated, open position.

A sectional door is fabricated from two or more elongated door sections. The length of the door sections is preselected in order to completely span the opening in which the sectional door is mounted. Each door section is placed with its plane oriented vertically. The door sections are hingedly mounted serially to the adjacent door section. The two opposite edges of the sectional door are movably mounted in a pair of support tracks, one on each side of the opening. Each track has a vertical component which supports the sectional door in its vertical, closure position across the opening. Each track also has a horizontal component which is secured at an elevated position above the opening. A curved section of track connects the vertical component with the horizontal component. The hinge mounting between door sections allows the sectional door to traverse the curved portion of the track between the open and closed positions. It is this traversal of the sectional door across the curved section of track that necessitates that the sectional door be constructed from individual door sections joined together by hinges in the foregoing edge-to-edge relationship.

The placement of the door sections in this edge-to-edge relationship creates a number of unique problems dealing not only with their overall alignment but also the weather resistance and safety of the sectional door. I developed a tongue and groove system for my steel sectional doors a number of years ago in order to assure that the sectional door retained a planar orientation when the sectional door was lowered to its vertical, closed position. Others have recognized the value of this feature and have freely copied my sectional doors. The tongue and groove system I adopted was also intended to improve the weather resistance of my sectional doors. Previously, the abutting edges of the door sections were flat so that a certain amount of wind could pass through the cracks. Also, any wind driven rain or spray could enter the garage through the cracks.

While my tongue and groove system did solve most of the problems associated with wind and wind-driven rain or sprays, a certain amount of residual moisture has been found to drip inside the garage as the door is opened. This moisture collects in the hinge space between the door sections and is held there under surface tension. The gravitational forces on the moisture in this location are insufficient to cause the moisture to drain away. However, once the sectional door is raised, the surface upon which the moisture has collected becomes tilted so that gravitational forces can overcome the surface tension resulting in water dripping inside the garage.

One commercially available sectional door has overcome this problem by extending the front facing of the upper door section downwardly across the space between the two door sections. This lip-type extension overlaps the upper, outer edge of the lower door section by only a centimeter or so but in a very close-fitting relationship. However, while this feature has solved the problems of water collecting in the joints between the door sections, it is my opinion that this type of construction is dangerous in that the lip acts as a very efficient guillotine for any fingers inadvertently placed in the gap that is created as the successive door sections traverse the curved portion of the track. Accordingly, while this particular door has solved the problem of water dripping inside the garage it has merely substituted a minor problem for a distinct danger, that is, severed fingers.

In view of the foregoing it would be an advancement in the art to provide an apparatus and method for inhibiting collected moisture from dripping from the joints in the sectional door as the sectional door is raised to its overhead position. Another advancement would be to provide a sectional door with a drip resistant tongue and groove system whereby collected moisture is inhibited from dripping inside the garage as the sectional door is opened. It would also be an advancement in the art to provide a tongue and groove system for a sectional door wherein the collected moisture is channeled to the edges of the sectional door as the sectional door is raised. Such a novel apparatus and method is disclosed and claimed herein.

BRIEF SUMMARY AND OBJECTS OF THE INVENTION

This invention involves a unique tongue system for the top edge of a door section of a sectional door. Specifically, the profile of the tongue has been changed from the conventional tongue having a generally trapezoidal cross sectional profile to a profile wherein the leading edge of the tongue is formed with a near-vertical face which creates a water channel when the door section is rotated as it is raised into the generally horizontal orientation. This water channel diverts any collected moisture to the respective ends of the sectional door thereby precluding water from dripping inside the garage as the sectional door is raised.

It is, therefore, a primary object of this invention to provide improvements in sectional doors by reducing water dripping inside the garage as the sectional door is raised to its overhead, open position.

Another object of this invention is to provide improvements in the method for inhibiting water from dripping from the sectional door as the sectional door is raised.

Another object of this invention is to provide a modified tongue for a sectional door, the modified tongue forming a water channel for diverting collected moisture to the ends of the sectional door.

Another object of this invention is to provide a slight undercut in the leading face of the tongue, the undercut forming one side of a V-shaped water channel along the top edge of the door section.

These and other objects and features of the present invention will become more readily apparent from the following description and the accompanying drawing taken in conjunction with the appended claims.

DETAILED DESCRIPTION OF THE PREFERRED EMBODIMENT

Figure 1:
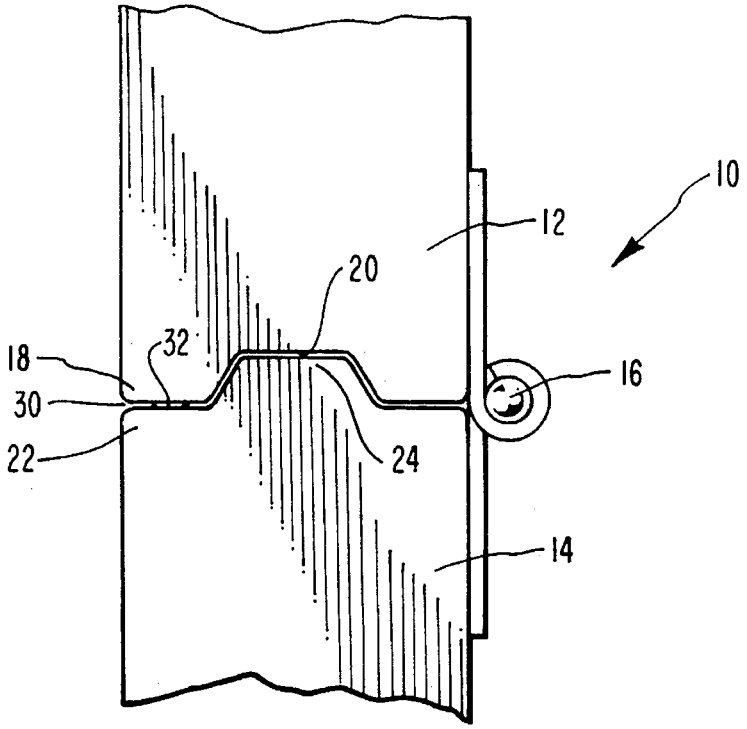
FIG. 1 (PRIOR ART)
FIG. 1 (PRIOR ART) is a fragmentary, cross-sectional view of the tongue and groove joint between door sections of a conventional sectional door, the sectional door being oriented vertically in the closed position.

The invention is best understood by reference to the drawing wherein like parts are designated by like numerals throughout in conjunction with the following description.

General Discussion

The present invention is a unique tongue system wherein the leading face of the tongue has been reshaped to provide a water channel across the length of the tongue. This water channel is designed to catch any moisture collected in the sectional door joint. The collected water is diverted to the ends of the sectional door thereby effectively eliminating any water dripping inside the garage as the sectional door is raised to its elevated open position. Only the leading face of the tongue is changed so that the rest of the tongue retains its conventional stabilizing relationship with the groove into which it is nested.

The channel formed into the leading face of the tongue in this presently preferred embodiment of the invention is formed as a near vertical face having a slight undercut of, say, ten degrees from the vertical. Clearly, of course, one could form the leading face with a perpendicular orientation although I have found that a slight undercut helps retain the initial surge of moisture as the water breaks its surface tension and begins to collect in the diversion channel as the sectional door begins to tilt as it is being raised.

Discussion of the Prior Art

Figure 2:
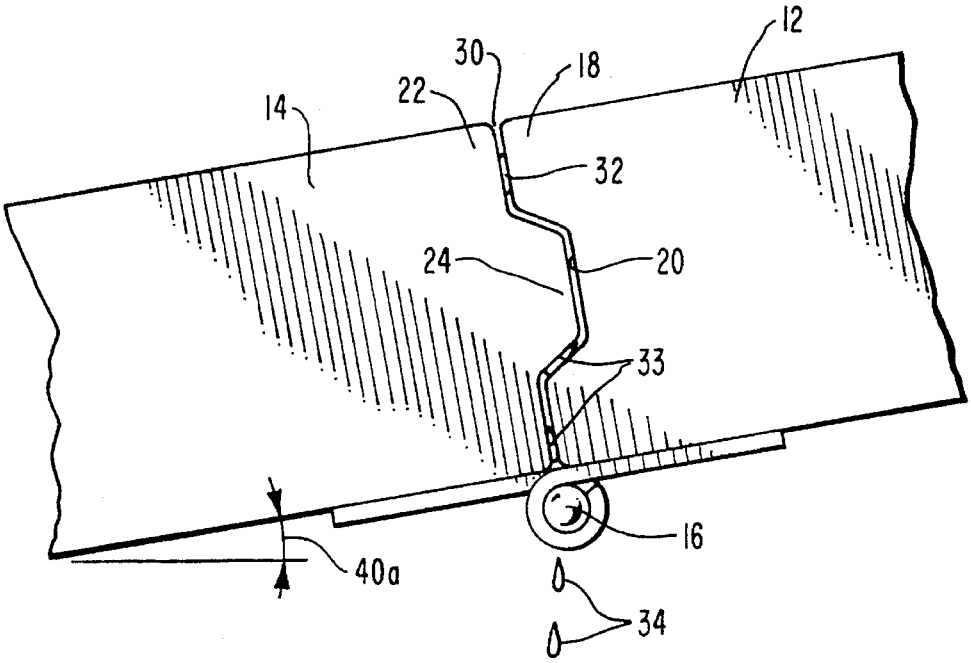
FIG. 2 (PRIOR ART)
FIG. 2 (PRIOR ART) is the sectional door of FIG. 1 shown being raised to the elevated, open position.

Referring now to FIGS. 1 and 2 (PRIOR ART) the prior art tongue and groove joint of a conventional sectional door is shown generally at 10 and includes an upper door section 12 hingedly mounted atop a lower door section 14 by a hinge 16. Sectional door 10 is any conventional sectional door, whether constructed from wood or sheet metal. Further, hinge 16 is shown stylized for ease of illustration purposes.

Door section 12 has a bottom edge 18 having a groove 20 formed in the face thereof. Correspondingly, door section 14 has a top edge 22 with a tongue 24 formed in the face thereof. Both tongue 24 and groove 20 are formed with a generally trapezoidal cross-sectional profile and are dimensional configured so that tongue 24 nests within groove 20. The cooperation between tongue 24 and groove 20 provides sectional door 10 with increased dimensional stability while simultaneously reducing the flow of air through joint 30 formed between bottom edge 18 and top edge 22.

However, even through joint 30 may be formed as a fairly tight abutment surface between bottom edge 18 and top edge 22, a certain quantity of moisture 32 will collect within the confines of joint 30. Moisture 32 can be the result of moisture condensation, rain, lawn sprinklers, etc., and is held in joint 30 by the normal surface tension of water. Accordingly, it is immaterial how well or tightly joint 30 is formed, a certain quantity of moisture 32 will collect therein and be retained in joint 30 by the surface tension forces present in moisture 32. Moisture 32 remains in joint 30 until sectional door 10 is raised to its elevated, open position (FIG. 2, PRIOR ART). During this transition from the vertical, closed position to the elevated, open position two events occur that affect moisture 32. First, joint 30 opens widely as door sections 12 and 14 sequentially traverse the curved section of supportive track (not shown) between the vertical and horizontal orientations. This opening of joint 30 releases the surface tension of moisture 32 against bottom edge 18 allowing the normal surface tension within moisture 32 to cause moisture 32 to collect and to form beads of water 33 on top edge 22. Continued upward movement of sectional door 10 results in the second effect on water 33. Gravity (not shown) causes the water 33 to migrate downwardly across the face of tongue 24 and through the remainder of joint 30 where it drips as water drops 34 from sectional door 10.

At this juncture it should be noted that the orientation of sectional door 10 as shown in FIG. 2 is not in the horizontal plane but is angled upwardly a few degrees as represented by angle **40*a*. This is a conventional feature in almost all sectional doors that are configured to be opened into an elevated, generally horizontal orientation. However, angle 40*a* is insufficient to prevent water 33 from running downwardly across the leading face of tongue 24** under the force of gravity.

Figure 3:
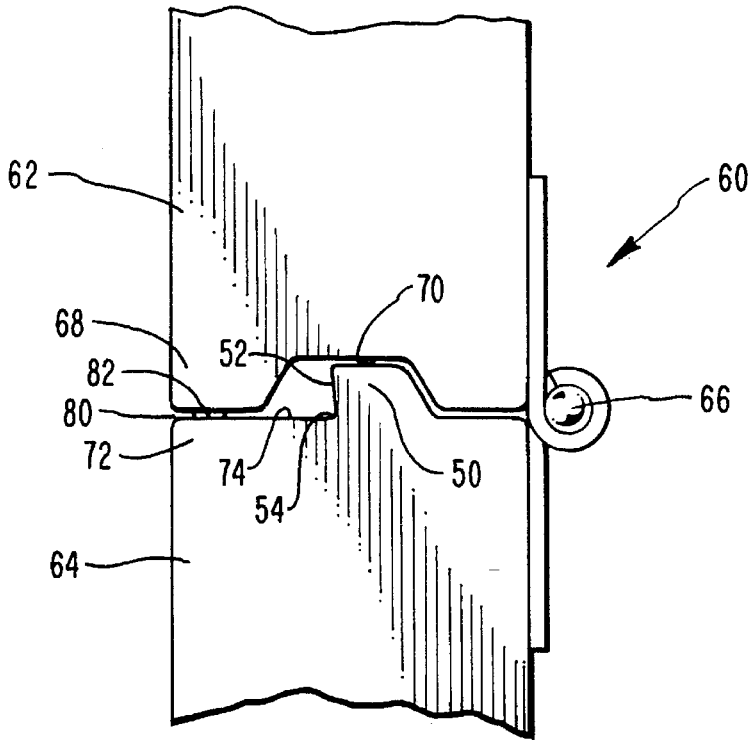
FIG. 3 is a fragmentary, cross-sectional view of the novel tongue system of this invention shown in the environment of a tongue and groove joint between door sections of a sectional door, the sectional door being oriented in the vertical, closed position.
Figure 4:
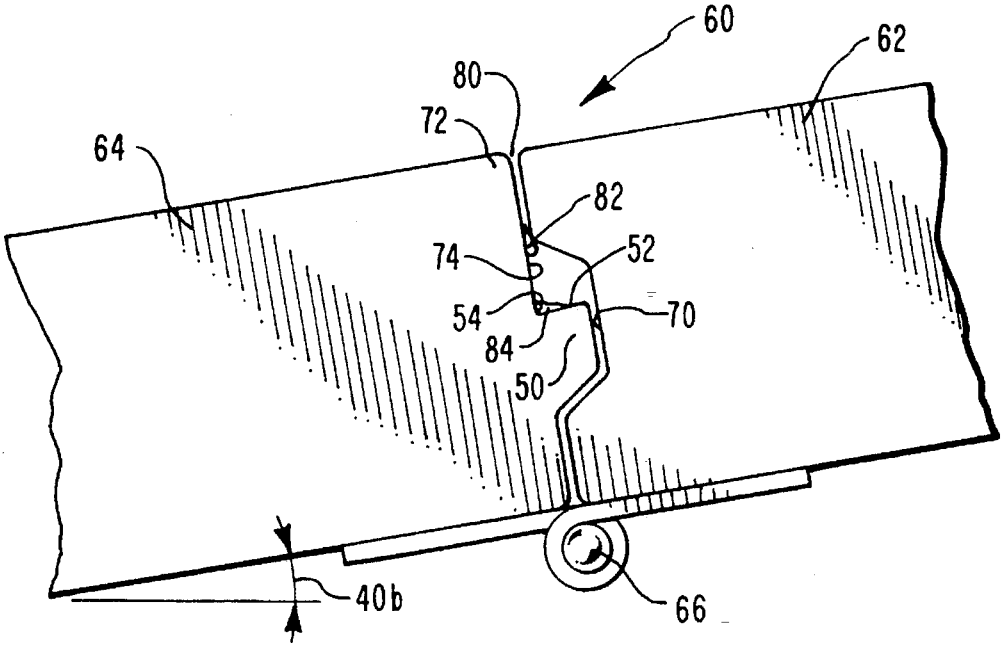
FIG. 4 is the novel tongue system of FIG. 3 showing the sectional door being raised to the elevated, open position.

Referring now to FIGS. 3 and 4, the novel water diversion tongue of this invention is shown generally at 50 and is shown in the environment of a sectional door 60, sectional door 60 including an upper door section 62 hingedly mounted to a lower door section 64 by a hinge 66. Upper door section 62 includes a bottom edge 68 having a groove 70 formed in the face thereof. Lower door section 64 includes a top edge 72 upon which a top face 74 forms the surface from which tongue 50 protrudes. Tongue 50 is configured with a leading face 52 which is oriented nearly perpendicular to top face 74 of top edge 72. I have prepared leading face 52 so that it has about a ten degree undercut into tongue 50 to thereby provide enhancements to the water diversion capabilities of tongue 50. Leading face 52 cooperates with top edge 72 and, more particularly, top face 74 thereon, to form a water diversion channel 54 on top edge 72. Water diversion channel 54 is created in the V-shaped space between top face 74 and leading face 52.

Sectional door includes a joint 80 between upper door section 62 and lower door section 64. Moisture 82 collects in joint 80 just as moisture 32 collects in joint 30 of sectional door 10 (FIGS. 1 and 2, PRIOR ART). However, as sectional door 60 is raised to its elevated, open position shown in FIG. 4, moisture 82 collects as water 84 into water diversion channel 54 where it is directed outwardly to the edges of sectional door 60. Accordingly, none of water 84 passes on through the rest of joint 80 thereby precluding any of water 84 dripping from sectional door 60.

Sectional door 60 in the elevated, open position shown in FIG. 4 is oriented at an angle **40*b* which is slightly offset above the horizontal. This angular offset coupled with the slight undercut of leading face 52 provides water diversion channel 54 with sufficient depth to accommodate the anticipated quantity of water 84 collected therein in joint 80. Accordingly, water diversion channel 54 very effectively reduces, if not substantially eliminates any of water 84 dripping from sectional door 60**.

The Method

In practicing the method of this invention, the profile of tongue 50 is modified from the profile of a conventional tongue (tongue 24, FIGS. 1 and 2, PRIOR ART) by having leading face 52 formed thereon. Leading face 52 is formed having a slight undercut thereto so as to more effectively create water diversion channel 54 in combination with top face 74. The formation of this undercut to leading face 52 is unique in that one does not generally expect the tongue of a sectional door joint to have other than the conventional trapezoidal profile. This undercut of leading face 52 coupled with the tilted orientation of sectional door 60, as represented by angle 40*b*, contributes to the overall water-handling capacity of water diversion channel 54 for handling water 84.

Sectional door 60 is assembled like any other sectional door (see sectional door 10, FIGS. 1 and 2, PRIOR ART) by assembling upper door section 62 atop lower door section 64 and hingedly joining them together with a plurality of hinges 66. Advantageously, tongue 50 nests easily within the profile of groove 70 to provide substantially all of the structural benefits of a conventional tongue and groove construction. Accordingly, when viewed from the exterior, sectional door 60 appears identical to any other sectional door, tongue 50 being concealed inside groove 70 and joint 80. However, even though sectional door 60 presents the identical external appearance as sectional door 10 (FIGS. 1 and 2, PRIOR ART) any moisture 82 in joint 80 will not drip from sectional door 60 when it is raised to its elevated, open position. Instead moisture 82 collects as water 84 and is diverted by water diversion channel 54 to the respective ends of sectional door 60.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A tongue of a tongue and groove joint between adjacent door, said sectional door being disposable in a vertical closed position and a horizontal open position, sections of a sectional door, said tongue including a water diversion channel comprising:

a leading face on said tongue, said leading face having an undercut, said undercut formed by two walls defining an acute angle therebetween forming a basal element of said water diversion channel when the sectional door is oriented toward the horizontal position.

2. The water diversion channel defined in claim 1 wherein said undercut is formed as a planar surface in said leading face.

3. The water diversion channel defined in claim 2 wherein said undercut is formed as a planar surface in said leading face.

4. A water diversion channel formed into a tongue of a tongue and groove joint between adjacent door sections of a sectional door, said water diversion channel comprising:

a tongue extending upwardly into a groove of an adjacent door section; and a water diversion channel formed as an undercut element in a leading face of said tongue, said undercut element being formed by two walls defining an acute angle therebetween.

5. The water diversion channel defined in claim 4 wherein said undercut element includes a planar surface undercut into said tongue of about 10 degrees.

6. A method for inhibiting water from dripping from a joint between door sections of a sectional door, the sectional door having a first edge and a second edge and a tongue and groove, on respective edges of each door section so as to form an engaging relationship between adjacent door sections, comprising the steps of:

shaping a leading face of the tongue thereby forming a water diversion channel formed by two walls defining an acute angle therebetween in the leading face in the tongue;

collecting water in said water diversion channel; and diverting said water to the first edge and the second edge of the sectional door with said water diversion channel thereby inhibiting said water from dripping from the joint between door sections when the sectional door is raised to its elevated, open position.

7. The method defined in claim 6 wherein said forming step includes undercutting said leading face thereby increasing the carrying capacity of said water diversion channel.

* * * * *